US005113059A

United States Patent [19]

Brewster, Jr.

[11] Patent Number: 5,113,059

[45] Date of Patent: May 12, 1992

[54] POSTAGE METER SECURITY SYSTEM

[75] Inventor: William H. Brewster, Jr., Norwalk, Conn.

[73] Assignee: Pitney Bowes Inc., Stamford, Conn.

[21] Appl. No.: 633,541

[22] Filed: Dec. 24, 1990

[51] Int. Cl.[5] ..... G07G 1/00

[52] U.S. Cl. ..... 235/101

[58] Field of Search ..... 235/101; 101/91

[56] References Cited

U.S. PATENT DOCUMENTS

| | | | |
|---|---|---|---|
| 1,874,074 | 8/1932 | Wheeler, Jr. et al. | 101/91 |
| 4,559,444 | 12/1985 | Erwin et al. | 235/101 |
| 5,020,429 | 6/1991 | Riley et al. | 101/91 |

*Primary Examiner*—L. T. Hix
*Assistant Examiner*—Eddie C. Lee
*Attorney, Agent, or Firm*—Charles G. Parks, Jr.; David E. Pitchenik; Melvin J. Scolnick

[57] ABSTRACT

A postage meter having a plurality of value wheels extending through a window in a housing, and die protector bars between the value wheels, the die protector bars having a first position at which they extend a further distance from the housing than the value wheels, and a second, retracted, position. The die protector bars extend in the housing between a pivot block and a cam block. A die shield is slidably movable between a first position aligned with the window, and a second, retracted, position. The cam block and dead bolt are positively moved in common via cam surfaces, by a rotatable yoke. A latch lever may engage the dead bolt to latch the postage meter to a mailing machine.

16 Claims, 7 Drawing Sheets

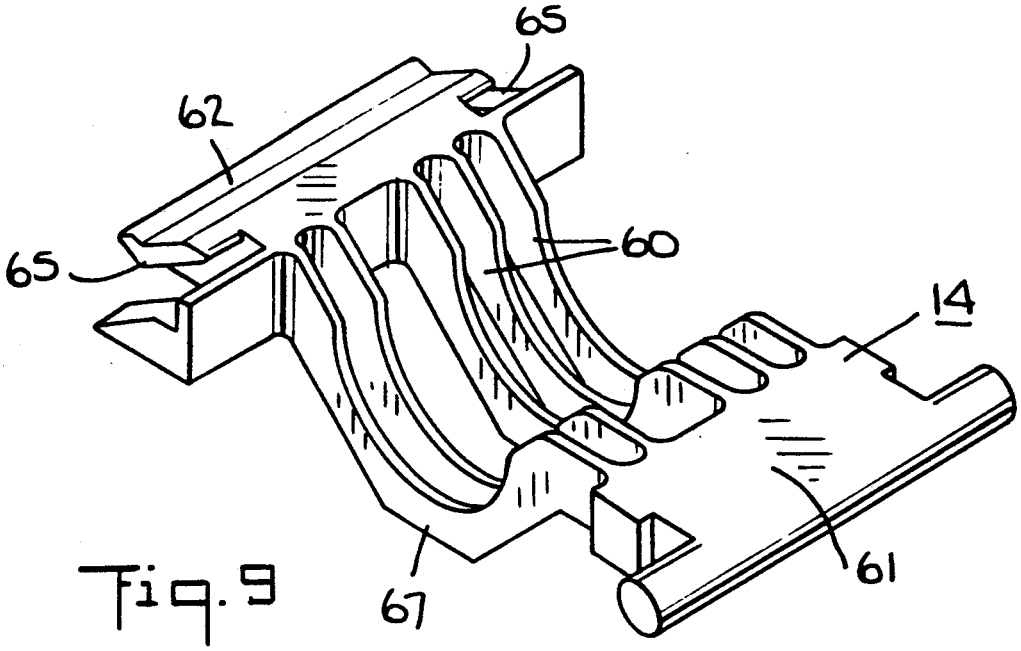
Fig. 9
Fig. 8
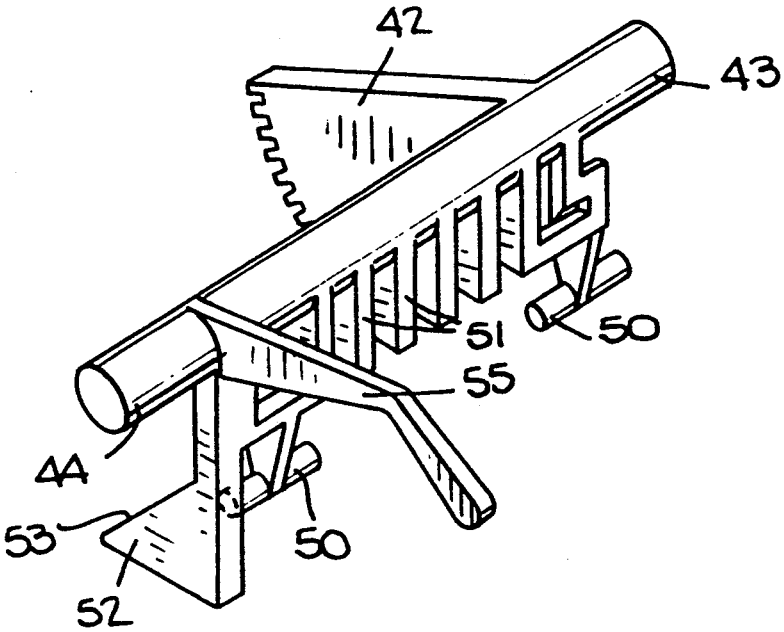

POSTAGE METER SECURITY SYSTEM

FIELD OF THE INVENTION

This invention relates to postage meters, and is more in particular directed to an improved system for protecting the integrity of postage meters.

BACKGROUND OF THE INVENTION

One known type of postage meter has a housing with settable value wheels rotatably mounted therein. The value wheels have die surfaces extending a determined distance through a window in the housing. In this postage meter, a platen is adapted to convey a mail piece, such as an envelope, into engagement with the die surfaces of the value wheels exposed from the housing. In such an arrangement it is necessary to provide means for insuring that the die surfaces of the value wheels are exposed only during a print cycle, in order to ensure that all postage printed by the machine is properly and accurately accounted.

In such mechanisms, at present there exists two arrangements for protecting the die surfaces of the value wheels from printing unaccounted postage. One of these is comprised of a series of die protector bars which protrude between the value print wheels. At all times other than a print cycle, these die protector bars are locked in a position sufficiently below the print surface to prevent printing of the value wheel characters.

The other arrangement consists of a shield which completely covers the exposed value wheels and all other print elements. At all times other than a print cycle, this shield is locked in a home position covering the print plane.

SUMMARY OF THE INVENTION

The invention is directed to provisions of a security system for a postage meter of the above type, wherein the die protector and dead bolt are controlled in a secure manner by a simple and inexpensive arrangement.

Briefly stated, the die protector has a first position at which it extends below the printing surface, or die surface, of the value wheels, and a second position at which it is drawn upwardly so that the die surface can be used to print postage. A dead bolt in the housing is positioned to be aligned with a recess in the die shield, to have a first position at which it enters the recess to prevent movement of the die shield away from the first position of the die shield in alignment with the value wheels. The dead bolt has a second, or upper position, at which the die shield is free to be moved rearwardly to permit the printing of postage.

In accordance with the invention, an actuator such as a rotatable yoke is provided that is adapted to be moved, for example by a stepping motor, between first and second positions. The yoke may be comprised of a rotatable shaft having cam riders depending therefrom. The die protector preferably comprises a plurality of parallel spaced apart die protector dies extending between a pivoted block and a cam block. The cam block carries cams that cooperate with the cam riders extending from the yoke, to enable the movement of the yoke to positively control the positions of the die protector bars. The cam surfaces are preferably configured to enable positive driving of the die protector by the yoke in each direction of movement thereof.

In addition, in the first position of the yoke, the die protector cannot be forced by external forces from its first position. For this purpose, over center yoke cam riders are provided over flats on the die protector cam surface.

A further projection extending from the shaft of the yoke has an additional cam surface thereon that coacts with the dead bolt, so that the dead bolt is moved simultaneously with the die protector.

In addition, a latch lever may be provided in the postage meter housing and positioned to be actuated by movement of the dead bolt. This latch lever has a latch hook thereon adapted to engage a latch projection of a mailing machine or the like, when the postage meter is in a postage printing mode, to prevent separation of the postage meter from the mailing machine during such times.

The present invention increases the reliability of postage meter security systems, while reducing the cost thereof relative to comparable known systems, in terms of unit cost, power conservation and parts count reduction.

BRIEF DESCRIPTION OF THE DRAWING

In order that the invention may be more clearly understood, it will now be disclosed in greater detail with reference to the accompanying drawing, wherein:

FIG. 8 is a perspective view of a yoke for the security system of the invention; and FIG. 9 is a perspective view of a die protector for the security system of the invention.

DETAILED DISCLOSURE OF THE INVENTION

Figure 1:
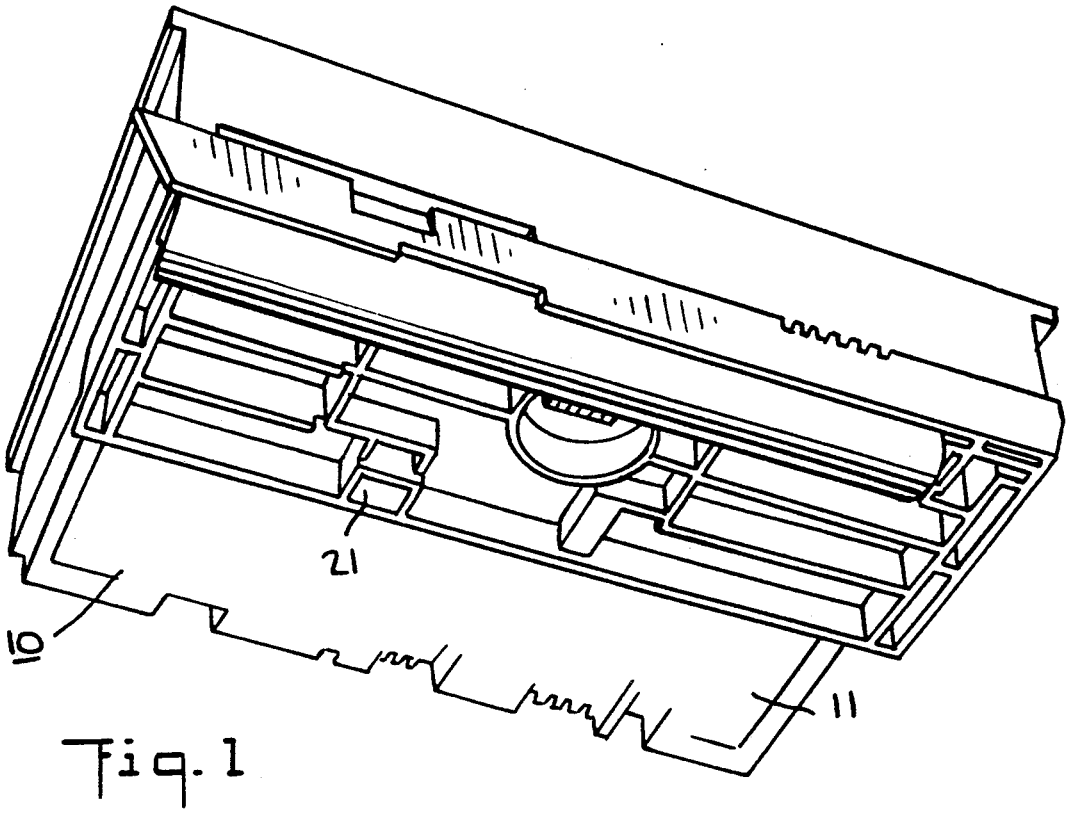
FIG. 1 is a perspective view of the underside of a postage meter in accordance with the invention, with the die shield thereof covering the die wheels.

In the drawings, only those portions of a postage meter and associated elements necessary to understand the invention will be specifically described, in order to enable a clearer appreciation of the invention. While the described postage meter is of the type adapted to be mounted to and have determined interactions therewith, it is apparent that the invention is not limited to this feature.

While reference is made herein to various directions, such as up, down, etc., it will be apparent that such reference is made only for the clarity in the description, and is not limitative of the invention.

Figure 2:
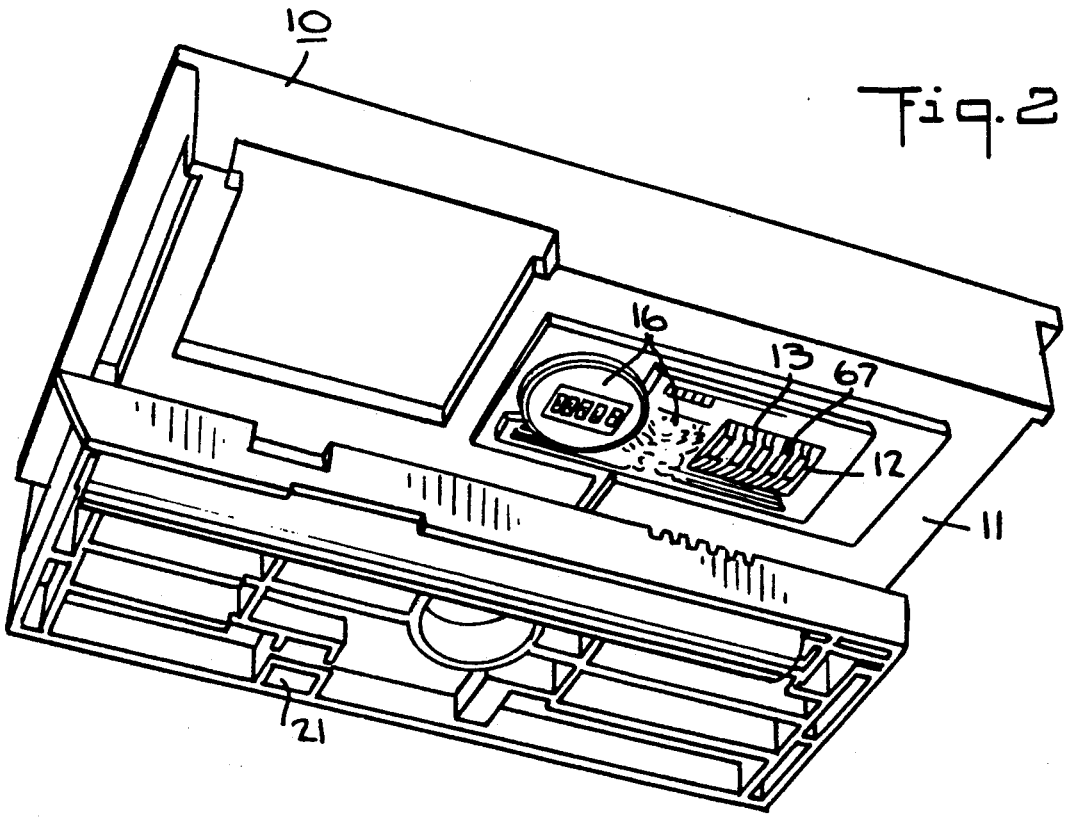
FIG. 2 is a perspective view corresponding to FIG. 1, with the die shield withdrawn from the die wheels.

As illustrated in FIGS. 1 and 2, a postage meter includes a housing 10 having a bottom wall 11. In one area of the bottom wall 11, the lower surfaces of a plurality of print or value wheels 12 project through a window 13 in the bottom wall, these lower surfaces being positioned slightly below the under surface of the bottom wall. The lower surfaces 67 of a die protector 14 (FIG. 3) also project through the window 13, to be below the lower surfaces of the value wheels 12, so that, in this position of the die protectors, a mail piece or the like cannot be directly pushed against the value wheels.

This area of the bottom wall may also be provided with other dies 16 employed in the printing of indicia, such as the date and post office location.

A die shield 20 is mounted to the bottom of the housing 10, and adapted to be slid to a first position under, and protecting, the value wheels (FIG. 1), and a second position at which the value wheels 12 are exposed (FIG. 2). The sliding mounting of the die shield may advantageously be effected by a control bar (not illustrated in FIGS. 1 and 2) extending from a mailing machine (also not shown in FIGS. 1 and 2) and engaging a recess 21 in the underside of the die shield.

Referring now to FIGS. 3–7, suitable projections 30, only one of which is illustrated, extend upwardly from the bottom wall 11 to support a shaft 31 on which the plurality of print or value wheels are journalled, the shaft 31 extending parallel to the bottom wall 11. As discussed above, the value wheels are mounted so that the lower peripheral surface of each of them extends through the aperture 13 in the bottom wall, so as to enable dies thereon to print indicia on a mail piece or the like urged toward the bottom wall.

The value or print wheels are conventional, and may be set for example by setting bars 35 that coact with ratchet wheels 36 (see FIGS. 5–7) affixed to the side of each of the print wheels. The setting bars 35 extend rearwardly to a position adjacent an aperture 36 in the rear wall of the base, for physical actuation by a setting bar 38 or the like of a mailing machine. For example, the mailing machine may include solenoid or motor actuated setting bars for individually pushing the setting bars, whereby each such "push" effects the rotational incrementing of the respective value wheel by one digit. Springs 39 (FIG. 3) are provided to urge the setting bars 35 against their respective ratchet wheels 36.

It will be understood that the invention is not limited to the use of the above described setting arrangement for the value wheels, and that other conventional mechanisms may be alternatively employed.

The security system in accordance with the invention is provided in order to ensure that the value wheels cannot be employed for printing indicia at any other time than during a print cycle, since the accounting of postage printed is only effected during such a print cycle. For this purpose, the invention provides means for simultaneously controlling the two above discussed mechanical print inhibiting devices, i.e. the die protectors 14 and the die shield 20, for inhibiting surfaces of the print wheels from being employed in any printing operation except during a print cycle.

Referring now to FIGS. 3, 4, 8 and 9, a preferred embodiment of the security system of the invention includes a stepping motor 40 mounted in the housing 10 and having a pinion 41. The teeth of the pinion 41 engage the teeth of a segment gear 42 affixed to the rear of a shaft 44 of an actuator or yoke 43. The shaft 44 is rotatably mounted on projections 45, 46 to extend parallel to the bottom wall 11. A rotary spring is provided on the shaft 44 to bias the shaft in the direction thereof that locks the die protector and die shield in a die protection mode, as will be described.

As seen more clearly in FIG. 8, a pair of spaced apart cam riders 50 are supported from the shaft of the yoke 43, generally below the shaft 44. These cam riders are comprised of short shafts each extending in both axial directions from a respective support. A plurality of bars 51 extend downwardly from the shaft 44 between the cam riders 50. A projection 52 extends downwardly from the shaft 44 adjacent the end thereof away from the segment gear 42, the projection 52 having an enlarged lower end with an upwardly directed inclined surface 53 on the upper side of the enlarged lower end. In addition, an elongated projection 55 extends generally forwardly of the shaft 44. While a specific configuration of the yoke is illustrated in FIG. 8, it will be apparent that variations may be made therein, within the scope of the invention.

Figure 4:
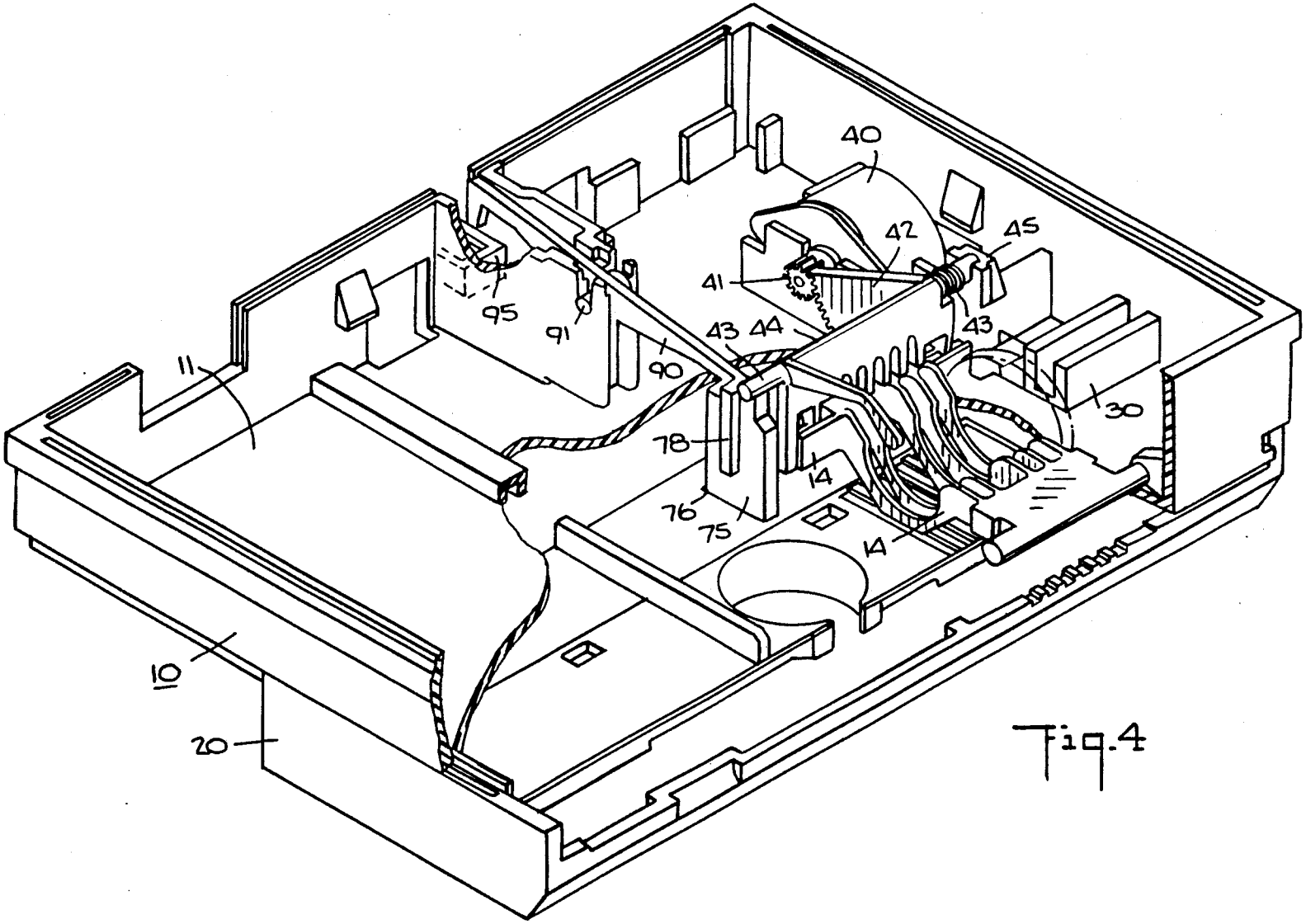
FIG. 4 is a top perspective view of the postage meter, taken from a different angle and being of a smaller scale than that of FIG. 3.

In a preferred embodiment of the die protector 14 as illustrated in FIG. 9, a plurality of parallel spaced apart generally arcuate die protector bars 60 extend between a front pivot block 61 and a rear cam block 62. The pivot block 61 has a pair of laterally extending shafts to enable the die protector to be pivotally mounted in the housing 10 at the front wall thereof, as seen in FIG. 4. The cam block 62 is provided with a cam surfaces 65 at each end thereof. These cam surfaces are each comprised of an upper cam surface that is axially spaced from a lower cam surface, the two cam surfaces of each pair being adapted to engage opposite ends of the short cam rider shafts 50 in order to enable the positive driving of the die protector in each rotary direction. The generally central lower surfaces 67 of the arcuate die protector bars 60 are adapted to extend through the window 13 of the housing, and these surfaces may be flat, as illustrated.

Figure 5:
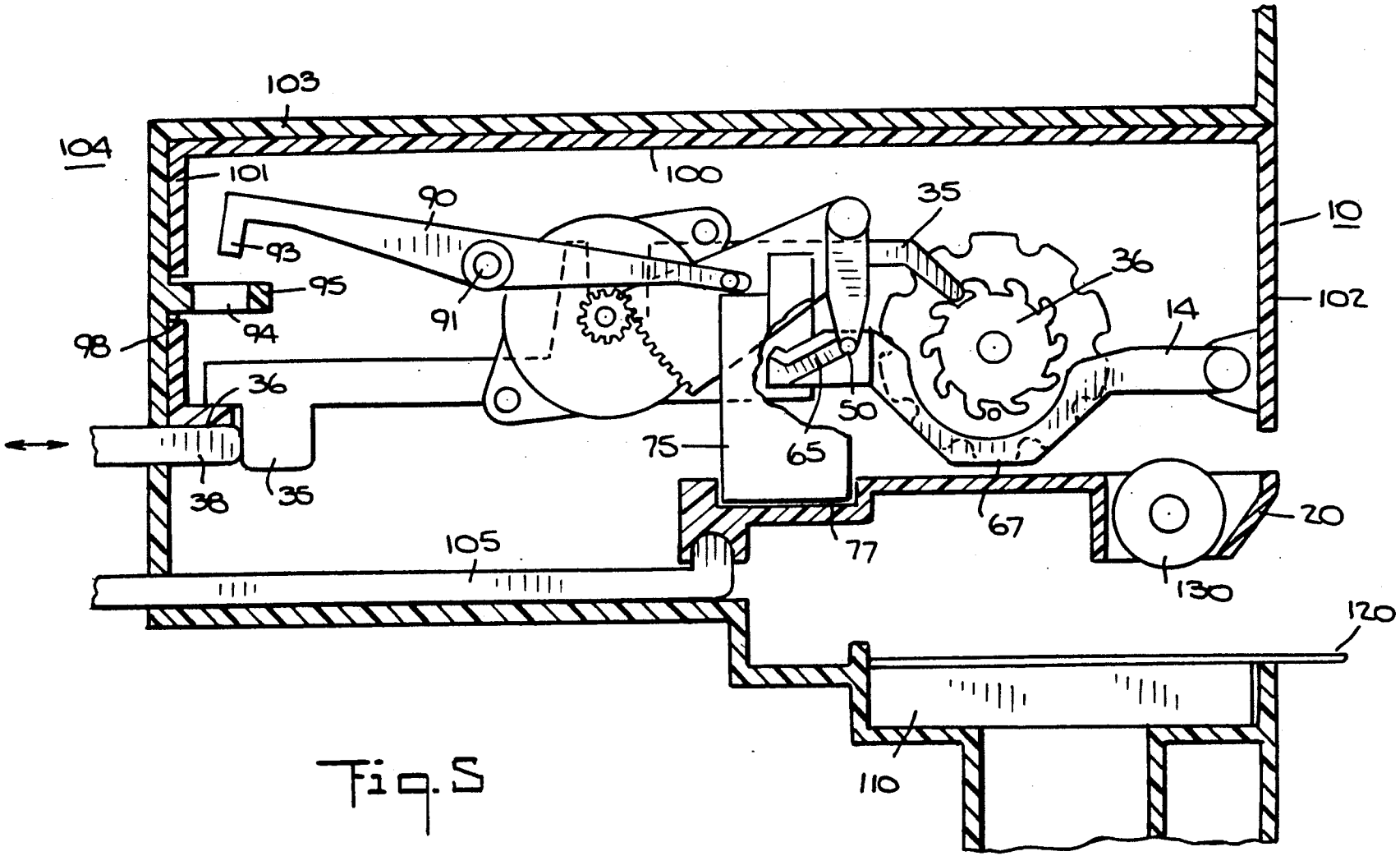
FIG. 5 is a cross sectional view of the postage meter, in combination with a portion of a mailing machine, with the die shield aligned with the die wheels and the die protector extending below the die wheels.
Figure 6:
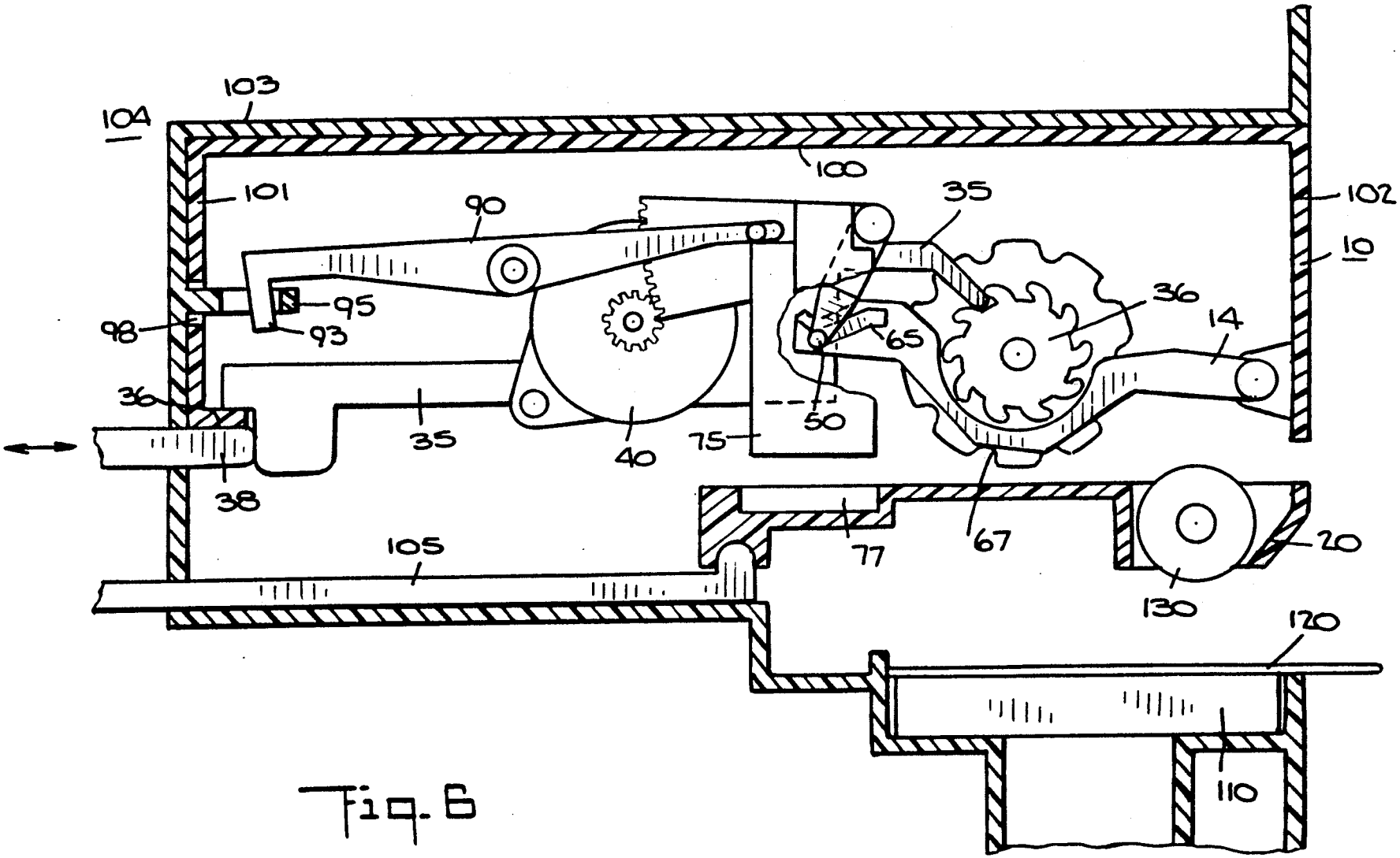
FIG. 6 is a cross sectional view corresponding to FIG. 5, but with the die protector moved upwardly to expose the die wheels.
Figure 7:
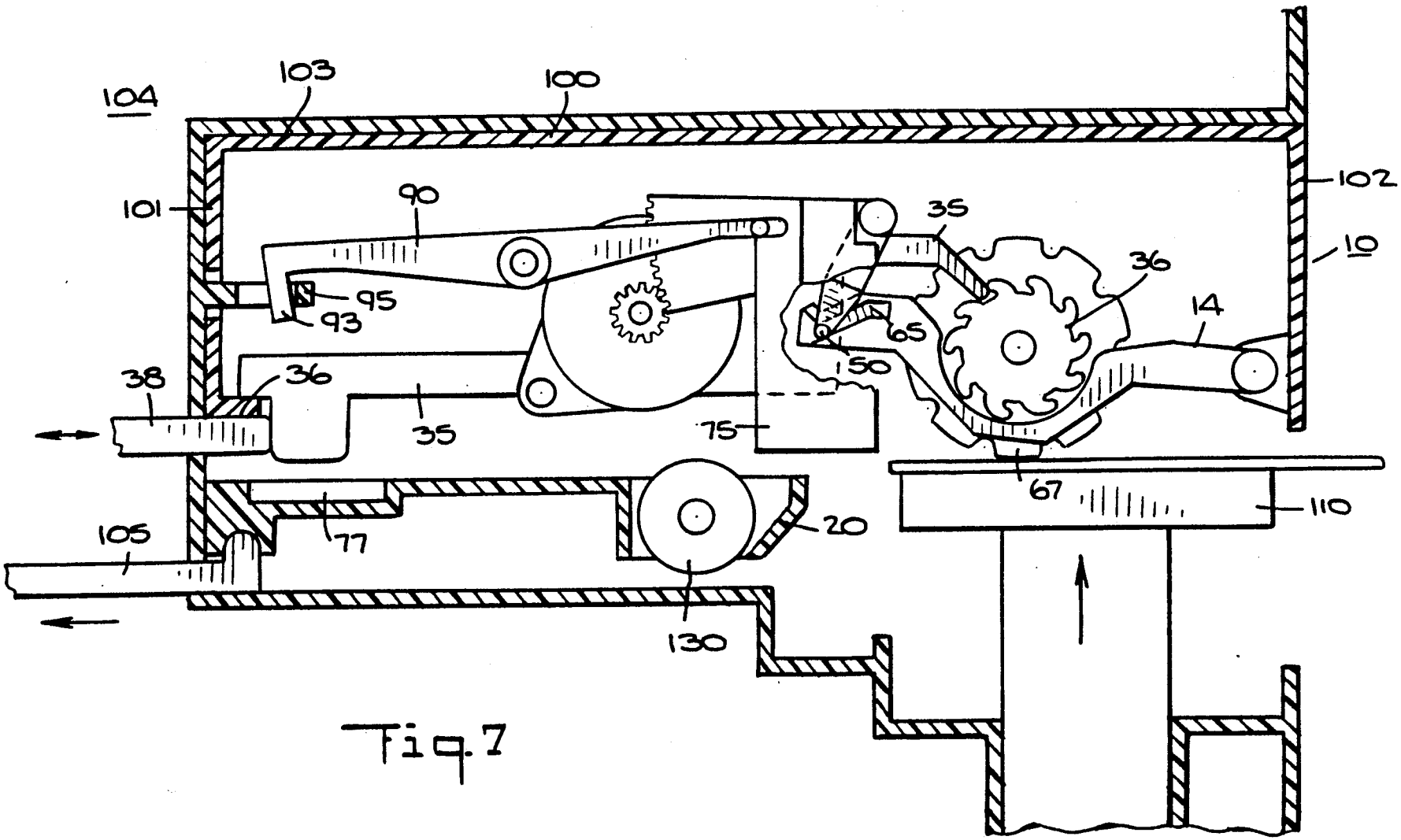
FIG. 7 is a cross sectional view corresponding to FIG. 6, but with the die shield withdrawn from the die wheels and a platen urging a mail piece against the die wheels.

As seen more clearly in FIGS. 5–7, the cam riders 50 of the yoke 43 extend into the cams 65 of the die protector 14, in order to pivotally move the die protectors in response to rotation of the stepping motor 40. The downwardly extending bars 50 of the yoke are adapted to abut or be adjacent the top of the cam block 62 of the die protector 14 in one position of the yoke, as seen more clearly in FIG. 4, in order to prevent external forces on the die protector bars from urging the die protector upwardly when the postage meter is not in a print cycle. (When the postage meter is in a print cycle, the rotation of the shaft by the stepping motor 40 effects the rotation of the bars 51 to a position at which the cam block 62 of the die protector can be raised.)

Figure 3:
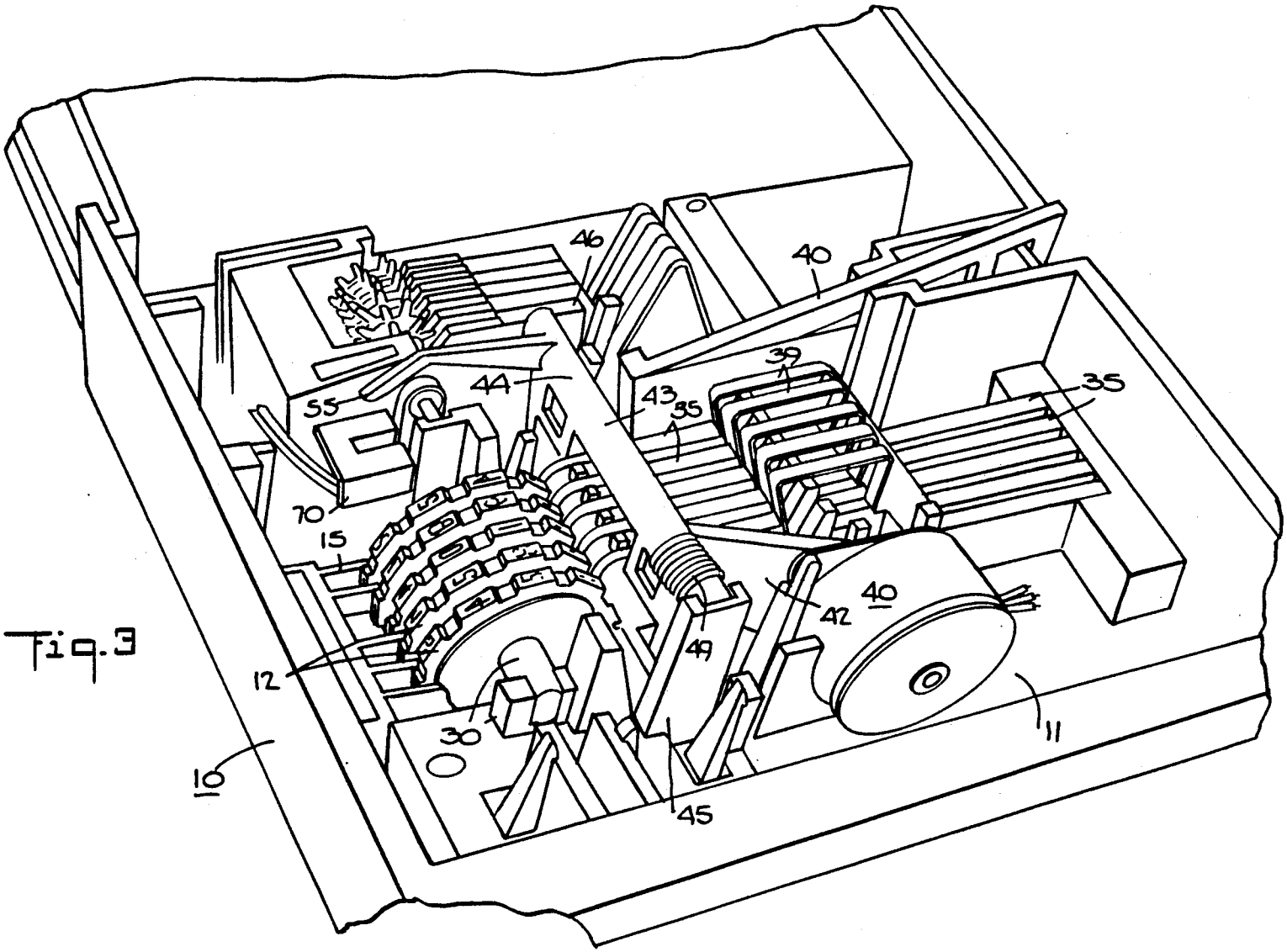
FIG. 3 is a top perspective view of the postage meter of FIG. 1, with the cover removed.

As more clearly seen in FIG. 3, the forward projection 55 of the yoke is axially aligned with a photosensor 70, to enable the photosensor to sense the position of this projection. Thus, by detecting the position of the projection 55 in a conventional manner, the photosensor provides a signal of a first sense when the postage meter is not in a print cycle (e.g. as seen in FIG. 5), and a signal of a second sense when the postage meter is in a print cycle (e.g. as seen in FIG. 7).

Referring especially to FIGS. 4–7, a dead bolt 75 is mounted in the housing for vertical movement, so that it can extend through an aperture 76 in the bottom wall of the housing. As seen in FIGS. 5–6, the dead bolt 75 is vertically aligned with a locking recess 77 in the die shield in the non-printing modes of the postage machine, so that it can enter this recess and prevent backward movement of the die shield. The dead bolt has a projection 78 on one side thereof, to prevent it from falling downwardly out of the aperture 76. A cam projection (not illustrated) is provided on the other side of the dead bolt and positioned to engage the inclined surface 53 of the projection 52 of the yoke 43. A suitable spring (not illustrated) is preferably provided to urge the dead bolt downwardly, to lock the die shield in its forward position. Thus, in the non-printing mode of the postage meter, as illustrated in FIGS. 4 and 5, with the yoke in its most counterclockwise position, the dead bolt is free to be moved downwardly through the aperture 76 to lock the die shield in its forward position. When the yoke is rotated clockwise under the control of the stepping motor, however, the inclined surface 53 forces the dead bolt upwardly to release the die shield to move rearwardly in a printing cycle.

When the postage meter is of the type adapted to be mounted to, and controlled by, a mailing machine, it is necessary in accordance with the invention to prevent the removal of the postage meter from the mailing machine during a print cycle. For this purpose, as illustrated in FIGS. 3–7, a locking lever 90 is pivotally mounted in the housing 10 for rotation about an axis 91, the lever extending preferably in a front-to-back direction. The forward end of the lever 90 extends to engage the top of the dead bolt 75, and the rear end is provided with a hook 93 adapted to be received in an aperture 94 of a projection 95 of a mailing machine.

The operation of the postage meter security system of the invention will now be explained with reference to FIGS. 5–7, which illustrate the elements of the postage machine and a mailing machine that cooperate to ensure the security of the postage meter. In these figures, certain elements of the postage meter, such as for example the bottom wall of the housing 10, have been omitted in order to clarify the operation of the system of the invention.

FIGS. 5–7 illustrate the postage meter, with its top wall 100, rear wall 101 and front wall 102, inserted in a recess 103 of a mailing machine designated generally by the reference numeral 104. The latching projection 95 of the mailing machine extends through the aperture 98 in the rear wall 101 of the postage meter, and die shield actuator 105 of the mailing machine engages the operating recess 21 of the die shield. In the illustrated arrangement, a platen 110, for example mounted in the mailing machine 104, is adapted to be moved vertically from a position spaced below the die shield as seen in FIG. 5, to a position adjacent the value wheels as seen in FIG. 7. This platen may be operated by conventional means, and hence the control thereof is not described in detail herein.

It will be further understood that the stepping motor 40 may be controlled in a conventional manner, for example by a microprocessor (not illustrated), in response to determined signals for the starting of a print cycle, and that the mailing machine may be conventionally controlled, for example by a microprocessor, to set the value wheels and control the die shield of the postage meter. The invention is not specifically concerned with the technique employed for such control.

FIG. 5 illustrates the operative positions of the elements in the non-printing mode of the postage meter. As illustrated, the die shield 20 is in its forward position, shielding the value wheels from exposure, and the die protector 14 is pivoted to its lowermost position to inhibit contact of the value wheels with other objects. In this position, the projections 50 of the yoke inhibit upward rotation of the die protector 14 (as seen in FIG. 4), the dead bolt 75 is in its lowermost position to prevent rearward movement of the die shield, and the latch lever 90 is pivoted clockwise to permit removal of the postage meter from the mailing machine, if desired.

In this position, the mailing machine may set the value wheels to any desired print value, and a mail piece 120 may be set upon the platen 110.

At the start of a print cycle, the stepping motor 40 is energized to rotate the yoke 43 clockwise. This rotation causes the cam riders 50 to urge the die protector 14 to move in a clockwise direction, so that their lower surfaces 67 are above the lowermost portion of the value wheels 12, as seen in FIG. 6. In addition, the inclined surface 53 of the yoke has raised the dead bolt 75, so that the die shield 20 is now free to be moved rearwardly to expose the value wheels. The raising of the dead bolt 75 effects the pivoting of the lever 90 counterclockwise, so that its hook 93 enters the aperture 94 in the latch projection 95, thereby preventing removal of the postage meter from the recess 103 in the mailing machine. This movement of the yoke is sensed by the sensor 70 (FIG. 3), since at this time the projection 55 of the yoke has moved adjacent the sensor. The sensor 70 thus signals the mailing machine, in conventional manner, that the postage meter is now set to print indicia on a mail piece or the like.

Upon receiving a signal in the above manner, that the postage meter is set to print postage, the mailing machine first withdraws the die shield actuator 105, to move the die shield rearwardly and expose the value wheels, as illustrated in FIG. 7. This rearward movement of the die shield causes an inking roller 130 carried by the die shield to engage the exposed sectors of the value wheels 12, to ink the dies thereon. Following the withdrawal of the die shield, the platen 110 is moved upwardly by the mailing machine, to force the mail piece against the exposed value wheel dies.

The returning of the postage meter to its non-printing mode is effected by controlling the mailing machine to lower the platen and return the die shield to its forward position, whereupon the postage meter is controlled to rotate the yoke counter-clockwise. Such movement of the yoke effects the lowering of die protector and dead bolt, the blocking of the die protector by the projections 51, and the rotation of the lever 90 to free the postage meter for removal, if desired.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. In a postage meter having a value printing die arranged with a surface extending through a window in a housing, a die protector movable between a first position at which said die protector extends through said window a greater distance than said surface and a second position at which said surface extends through said window a greater distance than said die protector, and a die shield mounted to be movable between a first position aligned with and adjacent said window and a second position that is not in alignment with said window, the improvement comprising a rotatable mounted yoke rotatable between a first and second position, first cam means coupling said yoke and die protector for positively moving said die protector between said first and second positions, said die shield having a recess, a dead bolt aligned with said recess at said first position of said die shield, and second cam means coupling said yoke and dead bolt for positively moving said dead bolt from said recess simultaneously with movement of said die protector from said first position thereof.

2. The postage meter of claim 1 wherein said yoke comprises a rotatably mounted shaft, said die protector comprises a pivotally mounted die protector bar, and said first cam means comprises first and second spaced apart cam surfaces on said die protector bar, and cam rider means mounted to said shaft and positioned to positively engage said first and second spaced apart cam surfaces upon opposite pivotal movement of said shaft.

3. The postage meter of claim 1 wherein said yoke further comprises means positioned to inhibit movement, of said die protector when said yoke is in said first yoke position.

4. The postage meter of claim 3 wherein said means to inhibit movement of said die protector comprises projection means extending from said yoke to abut said die protector at said first position thereof.

5. The postage meter of claim 1 wherein said second cam means comprises an inclined surface supported from said yoke and positioned to engage said dead bolt.

6. The postage meter of claim 1 further comprising spring means for resiliently urging said yoke toward said first position thereof.

7. The postage meter of claim 1 further comprising a generally centrally pivoted latch lever having a first end positioned to engage said dead bolt and a second end having thereon a hook and an aperture in said postage meter for receiving a latch element, said hook being positioned to engage said latch element when said yoke is in said second position thereof.

8. The postage meter of claim 1 further comprising means coupled to said yoke for sensing said first and second positions of said yoke.

9. In a postage meter having a housing, settable value wheels mounted in said housing to have die surfaces extending a determined distance through a window in said housing, die protector means mounted adjacent said value wheels and having a first position extending from said window a greater distance than said die surfaces and adjacent to said value wheels, and a second position wherein said die surfaces extend further outward of said housing than said die protector means, and a die shield movable between a first position aligned with and adjacent said window and a second position displaced from said window, the improvement comprising an actuator, a dead bolt movable between a first position inhibiting movement of said die shield and a second position permitting movement of said die shield, means for moving said actuator, and cam means responsive to movement of said actuator for moving said die protector and dead bolt simultaneously between their respective first and second positions.

10. The postage meter of claim 9 wherein said actuator comprises a yoke having a pivot shaft, and said cam means comprises cam rider means supported on said pivot shaft, said die protector having cam surfaces positioned to be engaged by said cam rider means.

11. The postage meter of claim 10 wherein said cam rider means comprises a support projecting from said pivot shaft, and shaft means extending axially of said pivot shaft from both sides of said support, said die protector means having a first side pivotally mounted to said housing and a second side with first and second axially spaced apart cam surfaces engaging said shaft means on opposite sides of said support, for positively controlling said die protector means for movement rotation of said shaft means in opposite directions.

12. The postage meter of claim 10 wherein said die protector means comprises a support block pivoted to said housing, a cam block spaced from said support block and including cam means, and a plurality of die protector bars extending between said support block and cam block, said die protector bars having surfaces extending through said window.

13. The postage meter of claim 12 further comprising blocking means extending from said pivot shaft for blocking pivoting of said support block at one angular displacement of said pivot shaft.

14. The postage meter of claim 9 further comprising a latching lever pivotally mounted in said housing for rotation about a pivot centrally disposed on said lever, said lever having a first end positioned to engage said dead bolt and a latch hook on the opposite end thereof, and an aperture in said housing adjacent said latch hook, whereby said latch hook is positioned to engage a projection extending into said aperture in the second position of said dead bolt.

15. The postage meter of claim 10 wherein said cam means further comprises a projection having an inclined surface and extending from said pivot shaft, said inclined surface being positioned to engage said dead bolt.

16. In a postage meter having a housing, settable value wheels mounted in said housing having die surfaces extending a determined distance through a window in said housing, die protector means mounted adjacent said value wheels and having a first position extending from said window a greater distance than said die surfaces positionable adjacent to said value wheels and a second position wherein said die surfaces extend further outward of said housing than said die protector means, and a die shield movable between a first position aligned with and adjacent said window and a second position displaced from said window, the improvement comprising a rotatable yoke element having a shaft, a dead bolt movable between a first position inhibiting movement of said die shield and a second position permitting movement of said die shield, means for rotating said shaft, said die protector means comprising a plurality of die protector bars extending between a pivot block pivoted to said housing and a cam block having cam surfaces, cam rider means depending from said shaft and engaging said cam surfaces, blocking projection means extending from said shaft for inhibiting pivoting of said die protector means at one angular position of said shaft, and a projection on said yoke having a cam surface engaging said dead bolt for lifting said dead bolt from said first position thereof to permit said die shield to be moved.

* * * * *